US005427173A

United States Patent [19]

Das et al.

[11] Patent Number: 5,427,173

[45] Date of Patent: Jun. 27, 1995

[54] INDUCTION SKULL MELT SPINNING OF REACTIVE METAL ALLOYS

[75] Inventors: Santosh K. Das, Randolph; Richard L. Bye, Morristown; Alexander Loboysky, New Providence, all of N.J.

[73] Assignee: AlliedSignal Inc., Morris Townwhip, N.J.

[21] Appl. No.: 179,837

[22] Filed: Jan. 7, 1994

Related U.S. Application Data

[63] Continuation of Ser. No. 928,392, Aug. 12, 1993, abandoned, which is a continuation-in-part of Ser. No. 618,583, Nov. 28, 1990, abandoned, which is a continuation of Ser. No. 345,254, May 1, 1989, abandoned.

[51] Int. Cl.[6] ..... B22D 11/06; B22D 11/10; B22D 11/18

[52] U.S. Cl. ..... 164/463; 164/471; 164/155.1; 164/479; 164/453; 164/423; 164/437

[58] Field of Search ..... 164/423, 463, 471, 493, 164/513, 155.1, 479, 453, 427, 437

[56] References Cited

U.S. PATENT DOCUMENTS

| | | | |
|---|---|---|---|
| 2,858,586 | 11/1958 | Brennan | 164/95 |
| 3,775,091 | 11/1973 | Clites et al. | 75/10.14 |
| 3,985,177 | 10/1976 | Buehler | 164/80 |
| 3,998,264 | 12/1976 | Hocking | 164/80 |
| 4,738,713 | 4/1988 | Stickle et al. | 75/10.14 |

FOREIGN PATENT DOCUMENTS

| | | |
|---|---|---|
| 0055827 | 7/1982 | European Pat. Off. . |
| 0095298 | 11/1983 | European Pat. Off. . |

OTHER PUBLICATIONS

S. H. Whang, "Rapidly Solidified Ti Alloys Containing Novel Additives", J. of Metals, Apr. 1984, pp. 34–40.

R. G. Rowe et al., "Titanium Alloy Melt Spinning", Proc. Structural Metals by Rapid Solidification, F. H. Froes & S. J. Savage ed., ASM Int. 1987, pp. 253–260.

D. J. Chronister et al., "Induction Skull Melting of Titanium & Other Reactive Alloys", J. of Metals, Applied Technology, Sep. 1986, pp. 51–54.

*Primary Examiner*—P. Austin Bradley
*Assistant Examiner*—Erik R. Puknys
*Attorney, Agent, or Firm*—Ernest D. Nuff; Roger H. Criss

[57] ABSTRACT

An apparatus for melting and rapid solidification casting of metal alloys has a crucible for molding a metal charge. The crucible has side walls, a top and a bottom having an orifice therein. Collectively, the side walls, top and bottom define an interior of the crucible. A portion of the dimensions of the side walls of the side walls and bottom is divided by longitudinal slits into at least two segments. A nozzle is disposed partially within the crucible and extends through the orifice. The nozzle has a first end in communication with the interior of tune crucible. A second end of the nozzle has a nozzle orifice therein for defining a stream of molten metal alloy. A cooling mechanism cools the top, side walls and bottom of the crucible. The apparatus has mechanisms for inducing alternating electrical currents within the metal charge and within the nozzle, and for establishing and maintaining pressure within the interior of the crucible. A positioning mechanism positions the crucible and nozzle means relative to a quenching mechanisms that includes a rapidly moving chill substrate. The crucible, nozzle and quenching mechanism are housed within an enclosure that provides there within a controlled atmosphere having positive or negative pressure.

2 Claims, 4 Drawing Sheets

INDUCTION SKULL MELT SPINNING OF REACTIVE METAL ALLOYS

CROSS-REFERENCE TO RELATED APPLICATIONS

This application is a continuation of application Ser. No. 928,392, filed Aug. 12, 1993, now abandoned, which application is a continuation-in-part of application Ser. No. 618,583, filed Nov. 28, 1990, now abandoned, which, in turn, is a file-wrapper-continuation of application Ser. No. 345,254, filed May 1, 1989, now abandoned.

FIELD OF THE INVENTION

This invention relates to a method and apparatus for rapid solidification of reactive metals and metal alloys; and more particularly, to an induction skull melting system having a nozzle through which a molten metal stream is directed onto a rapidly moving chill substrate to form a rapidly solidified continuous metal filament or ribbon.

BRIEF DESCRIPTION OF THE PRIOR ART

Rapid solidification has become an important process for production of new materials. Properties of materials produced by rapid solidification frequently exceed those of similar materials processed at slower solidification rates. The rapid solidification of materials has enhanced physical, mechanical and corrosion properties of a variety of alloy systems.

Rapid solidification processes that have been developed for producing material in quantities sufficient for practical application can be broadly classified in two categories, i.e. atomization and melt spinning. In atomization processes, a stream of molten metal is broken into fine droplets which cool quickly and solidify as fine powders suitable for subsequent consolidation into bulk shapes. Melt spinning processes which comprise chill block melt spinning and planar flow casting involve directing a stream of molten alloy onto a cooled substrate so that it solidifies as a thin foil or ribbon which is used in foil or ribbon form or mechanically comminuted into powder for subsequent consolidation. Common to the processes of each rapid solidification category is the requirement for a crucible in which the metal is melted and held in the molten state and a flow control device, —or nozzle, in which the molten metal stream is formed and controlled.

Rapid solidification efforts were initially concentrated on iron-based, nickel-based, aluminum-based and magnesium-based alloys. A wide variety of refractory materials are available for these alloy systems, which are non-reactive with the molten metal and are, therefore, suitable for use as crucibles and nozzles. Subsequently, there has been considerable interest in rapid solidification of reactive alloys, especially titanium and titanium-aluminides. These alloys are so reactive that conventional melting and pouring techniques, involving refractory crucibles, produce unacceptably high contamination levels owing to the dissolution of the crucibles.

A variety of processes have been developed for melting and casting conventional ingot titanium, titanium-aluminide and other reactive alloys. In general, each of these processes involves the use of a cold crucible. The alloy is melted in a crucible composed of material having a high thermal conductivity, usually water cooled copper, so that a skull of solid alloy forms between the molten alloy and the crucible, preventing any reaction between the alloy and the crucible. There are a number of methods in which the energy necessary to melt and hold the alloy in the molten state can be applied, including consumable or non-consumable electrode arc melting, plasma arc melting or electron beam melting.

The requirement in rapid solidification processes that a relatively small stream of molten metal be formed and controlled prevents applicability of conventional melting and casting techniques in rapid solidification of reactive metals. To address this problem, cold hearth melting techniques have been adapted for rapid solidification of reactive alloys. In a cold hearth process, the alloy is melted in a copper hearth containing a hole in the bottom. A non-consumable tungsten arc is used to melt a pool of metal in the hearth. When a molten metal pool of sufficient size is formed, the skull over the orifice is melted through, allowing the metal to flow through the orifice, forming a metal stream. The flow of molten metal is controlled by the size of the orifice and the hearth is pressurized relative to the orifice exit for additional control. The metal stream is then either atomized or directed onto a rapidly moving water cooled substrate to form a rapidly solidified ribbon. Arc melting with controlled pouring from the bottom of the hearth has been frequently used to produce rapidly solidified powders by atomization and rapidly solidified ribbons by melt spinning. S. H. Wang, "Rapidly Solidified Ti Alloys Containing Novel Additives" J. of Metals, April, 1984, pp 34–40. R. G. Rowe, R. A. Amoco "Titanium Alloy Spinning" in "Processing of Structure Materials", F. H. Froes and S. J. Savage, eds. ASM International, 1987 pp. 253–260.

One of the major limitations of an arc melt spinning or an arc melt atomization process is difficulty of processing other than small batches of material. The largest batch of titanium alloy cast to date with these methods is on the order of 1 kilogram. Scale-up is difficult because the processes require that the arc be used to melt through the skull at the bottom of the melt pool and this limits the depth of the pool. Increased melt volume can only be achieved by increasing the diameter of the hearth, but the volume of metal that can be melted and held in the molten state by a single arc is also limited.

The advantages of melting and casting processes utilizing induction heating have long been recognized, and induction heating is commonly used for a variety of metal alloy systems. Its application to high melting point reactive alloys has been achieved on a commercial scale. U.S. Pat. No. 3,775,091 to Clites et al. describes a process for the induction melting and forming of titanium and other reactive metals and metal alloys. The Clites et al. process employs a water cooled copper crucible located inside an induction coil. The crucible is split longitudinally by at least one slit to reduce the attenuation or shielding action caused by an electrically continuous crucible. The metal to be melted is placed in the crucible along with a quantity of slag material. Induction power is applied to heat the metal charge. As heating progresses, the slag melts and solidifies between the cold crucible wall and the hot metal, providing both thermal and electrical insulation between the crucible and the hot metal. Eventually, the initial charge melts forming a solid skull at the crucible walls with a molten pool contained within the skull. The crucible is then tilted to pour the molten alloy or, alternatively, the bottom of the skull can be continuously withdrawn and cooled so as to form a continuously cast ingot of the same dimension as the inside diameter of the crucible.

The Clites et al. process has been modified by increasing the number of slits in the crucible, thereby eliminating the need for the slag. The modified process permits melting of up to 75 pounds of titanium or 105 pounds of zirconium. Scale-up to between 400 and 500 pounds is said to be possible, the principle limitation being the size of the power source. D. J. Chronister et al. "Induction Skull Melting Titanium and Other Reactive Alloys" J of Metals, September, 1986, pp 51–54. Although the Clites et al. process offers some advantages over more conventional reactive metal melting processes, it does not address an important requirement of a molten metal delivery system for rapid solidification processing, namely, the requirement for a small, controlled molten metal stream.

There remains a need in the art and practice of rapid solidification of reactive alloys, such as titanium alloys and titanium-aluminides, for a processing system having a large cold hearth melting capacity together with a means for forming and controlling a metal stream appointed for rapid solidified by melt spinning.

SUMMARY OF THE INVENTION

The invention provides an apparatus and process for rapid solidification of reactive metals and their alloys in large batches (i.e. batch sizes as large as 5 kilograms or more). Generally stated, the apparatus comprises a crucible means for holding a metal charge. The crucible means has side walls, a top and a bottom having an orifice therein. Collectively, the side walls, top and bottom define an interior of the crucible. A portion of the dimensions of the side walls and bottom is divided by longitudinal slits into at least two segments. A nozzle means is disposed partially within the crucible means, and extends through the orifice. The nozzle means comprises a first end isolated from communication with the interior by a thin metal foil. A second end of the nozzle means further comprises a nozzle orifice for defining a stream of molten metal alloy. A cooling means is provided for cooling the top, side walls and bottom of the crucible means. The apparatus further comprises a first induction means for inducing an alternating electrical current within the metal charge. A second induction means is associated with the nozzle means for inducing an electrical current there within. The apparatus has pressure control means for establishing and maintaining positive pressure within the interior of the crucible, and a quenching means including a rapidly moving chill substrate. A positioning means positions said crucible and nozzle means relative to the quenching means. The crucible nozzle and quenching means are housed within an enclosure means that provides there within a controlled atmosphere having positive or negative pressure.

In addition, the invention provides a process for melting and rapid solidification casting of metal alloys, comprising the steps of:

(a) placing a solid charge composed of a metal alloy within an interior of a crucible means having side walls, a top and a bottom, said bottom having an orifice therein, said side walls top and bottom defining, collectively, said interior, and said side walls and bottom being divided over a portion of their dimensions by longitudinal slits into at least two components;

(b) melting said charge within said interior by inducing an alternating electrical current there within;

(c) continuously cooling said crucible walls and bottom to establish and maintain a layer of solid metal alloy from said melted change there against and thereby prevent contact between said molten metal and said side walls and bottom of said crucible;

(d) heating a nozzle disposed partially within said crucible means and extending through said orifice, said nozzle means comprising a first end isolated from communication with said interior by a thin metal foil and in communication with a second end through a passageway in said nozzle, and said second end comprising a nozzle orifice, to melt the thin metal foil and a portion of said layer adjacent said first end to establish communication with said interior and permit flow of said melted charge through said passageway and nozzle orifice;

(e) pressurizing said interior to establish and maintain there within a positive pressure, providing for flow of said melted charge through said nozzle orifice at a controlled flow rate; and (f) directing a stream, formed by flow of said melted charge through said nozzle orifice, into contact with a rapidly moving chill substrate to rapidly solidify said melted charge.

Advantageously, the method and apparatus of the invention provide for melting of reactive metals and their alloys in a cold wall crucible to minimize contamination from melt/crucible reactions. In addition, there is provided a means to form and direct in a controlled manner a stream of metal onto a rapidly moving water cooled substrate for rapid solidification. The apparatus is capable of producing rapidly solidified materials in larger batches than those currently produced and effects rapid solidification of reactive metals in an efficient, reliable manner.

The metal filaments or ribbons that are produced by this process are suitable for use as foils in the as-cast or annealed condition or may be comminuted into a powder appointed for consolidation into bulk articles using conventional powder metallurgy techniques.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1:
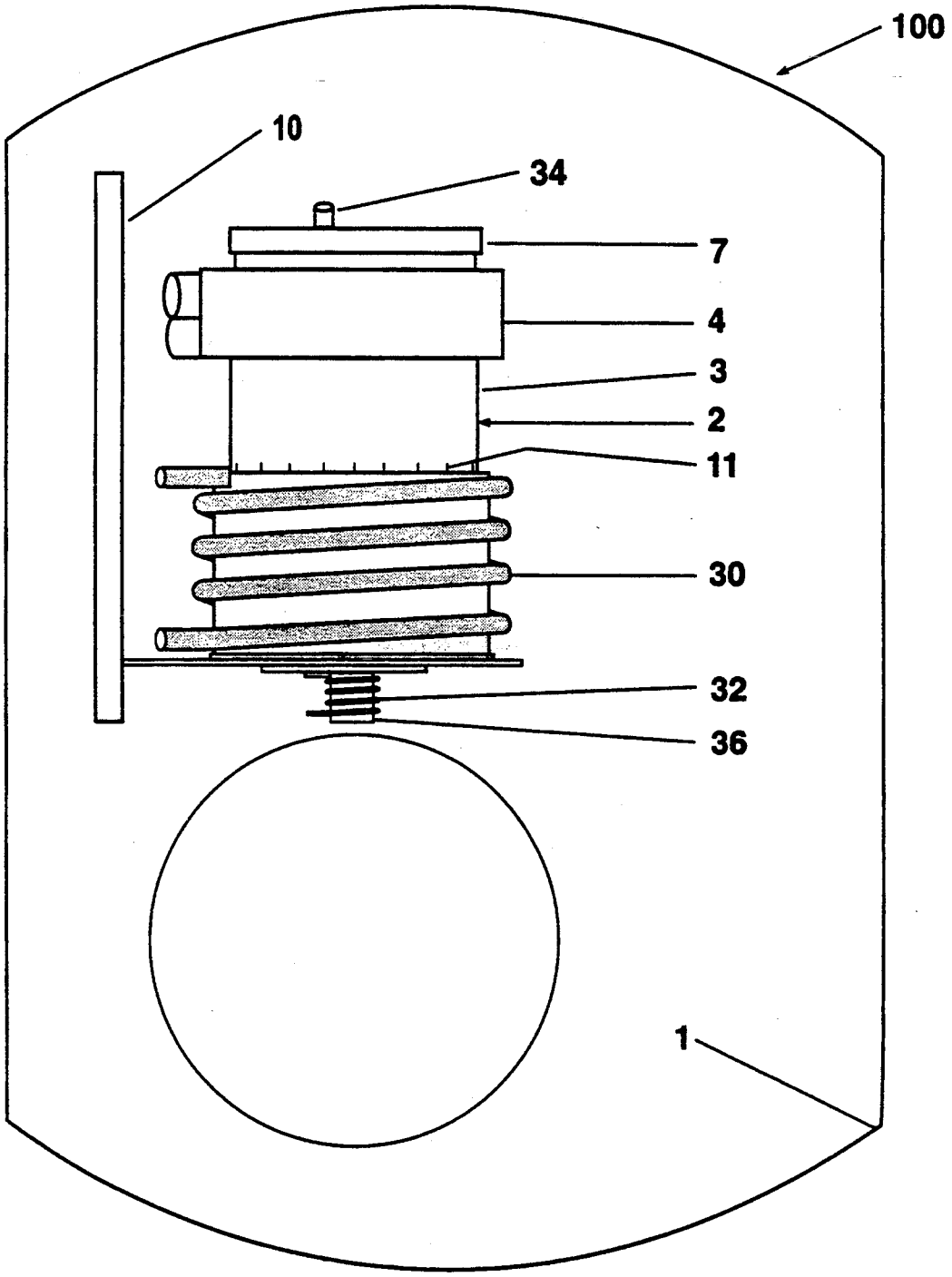
FIG. 1 shows a schematic representation of the apparatus of the invention located in a environmental chamber containing a water cooled casting wheel for the production of rapidly solidified ribbon.

Referring to FIGS. 1–5 of the drawings, there is shown a preferred embodiment for an apparatus for melting and rapid solidification casting of reactive metal alloys in a controlled atmosphere or vacuum.

Briefly stated the apparatus shown generally at 100, comprises a crucible means shown generally at 2, for holding a metal charge. The crucible means 2 has side walls 3, a top 7 and a bottom 20 having an orifice 5 therein. Collectively, the side walls 3, top 7 and bottom define an interior 22 of the crucible. A portion of the dimension of the side walls 3 and bottom 20 is divided by longitudinal slits 11 into at least two segments. A nozzle means 8 is disposed partially within the crucible means 2, and extends through the orifice 5. The nozzle means 8 comprises a first end 24 in communication with the interior 22. A thin foil means 25, of material having a composition compatible with the charge, is placed in the interior prior to melting. By "compatible" is meant that the material of which the foil is comprised has (1) a melting range slightly higher (approximately 50° C. or so higher) than that of the charge and (2) a composition in which a major component is the same as that of the charge. A second end 26 of the nozzle means further comprises a nozzle orifice 28 for defining a stream 6 of molten metal alloy. A cooling means 4 is provided for cooling the top 7, side walls 3 and bottom 20 of the crucible means 2. The apparatus 100 further comprises a first induction means 30 for inducing an alternating electrical current within the metal charge. A second induction means 32 is associated with the nozzle means 8 for inducing an electrical current there within. The apparatus 100 has pressure control means 34 for establishing and maintaining positive pressure within the interior 22 of the crucible 2, and a quenching means 36 including a rapidly moving chill substrate. A positioning means 10 positions the crucible and nozzle means relative to the quenching means 36. The crucible, nozzle and quenching means are housed within an enclosure means 1 that provides there within a controlled atmosphere having positive or negative pressure.

More specifically, there is shown in FIG. 1, a housing or chamber 1 that is constructed in such a manner to be gas tight. Chamber 1 encloses a crucible 2, a nozzle 8 and a casting substrate 36. Crucible 2 is preferably constructed of a metal having high thermal conductivity such as copper. The crucible 2 contains slits 11 part way up the sides 3 and in the bottom 20 so as to reduce the attenuation or shielding action which would be presented by an electrically continuous crucible. A cooling means 4 for supplying cooling water to the crucible 2 is provided. For this purpose, a water manifold which is an integral part of the crucible 2 is preferred. An induction coil 6 is positioned around the lower, or working portion of the crucible and is connected to a conventional induction power supply (not shown) and a source of cooling water (not shown).

The top of the crucible 2 is covered by a cap 7 preferably constructed from a material having high thermal and electrical conductivity, such as copper or a copper containing alloy. The cap is removable to allow access to interior 22 of the crucible 2 but capable of being tightly sealed to the crucible. The cap 7 is connected to a source of cooling water and contains a connection 34 through which an inert gas can be introduced in order to maintain a relative pressure difference between the crucible interior and the chamber environment.

A casting nozzle 8 constructed from a high melting point material such as a ceramic or refractory metal, preferably tungsten or molybdenum, is located beneath the crucible 2. The nozzle 8, preferably cylindrical in shape with an outside diameter smaller than the inside diameter of the crucible 2, is separated from the top 24 by a thin foil 25 and positioned in a hole 5 in the bottom of the crucible 2 so that the nozzle top 24 is open to the crucible interior 22 once the casting has begun. The nozzle 8 is closed at the bottom 26 except for a small orifice 28. An induction coil 30 is located coaxially with the nozzle 8 and is connected to a conventional induction power supply, distinct from that of the crucible 2, and a source of cooling water.

The crucible and nozzle assembly is supported by a frame 10 which is capable of adjusting the position of the assembly relative to a rapidly moving casting substrate 36. The casting substrate 36 is preferably a water cooled wheel constructed from material having high thermal conductivity, such as copper or one of its alloys, and is capable of being driven so as to achieve surface speeds of between 2500 and 7500 feet per minute.

Figure 2:
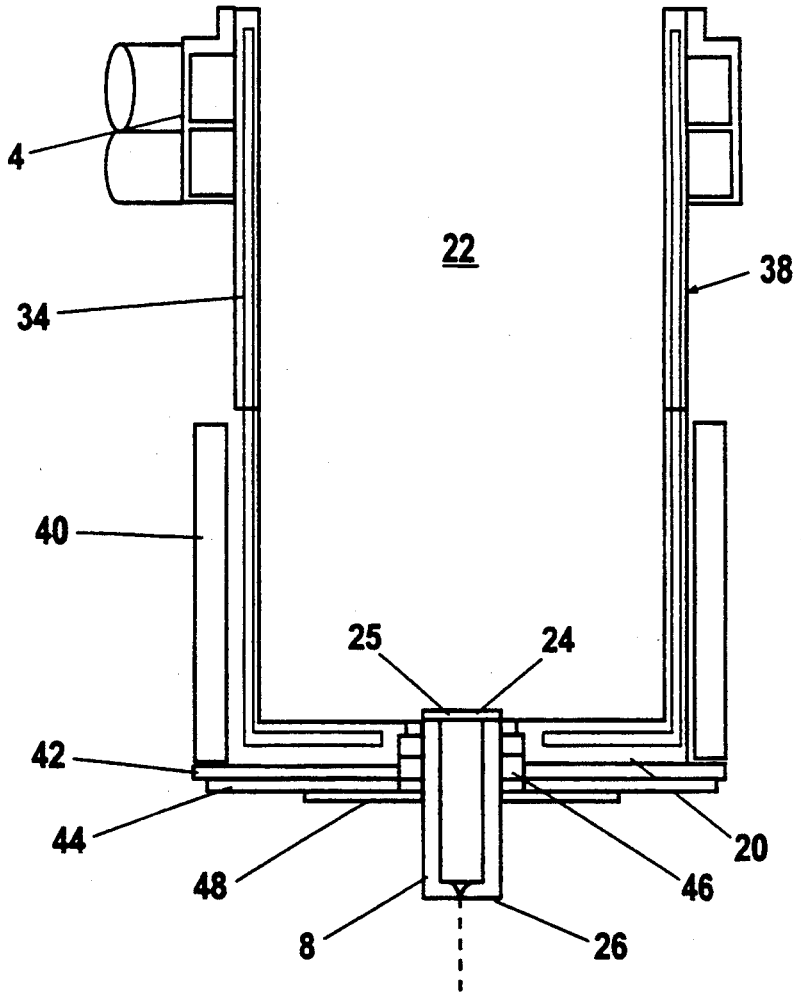
FIG. 2 shows a longitudinal cross-sectional view of the crucible and nozzle assembly employed in the apparatus of FIG. 1 illustrating construction details and relationships between casting crucible and nozzle.

FIG. 2 shows a longitudinal cross section of the crucible and nozzle assembly showing construction details and the relationship between the nozzle 8 and the crucible 2. The crucible bottom 20 and side walls 3 are segmented by slits 11 which extend approximately two thirds of the way up the side walls 3. The metal is melted and held in the lower portion of the crucible 2 only and the slits 11 must extend far enough up to provide for the electrical isolation of individual segments in that area. Internal passages 38 are provided in each segment for cooling water. Cooling water is supplied to the internal passages 38 through a manifold 4 which is an integral part of the crucible 2. The crucible 2 is encased in a cylinder 40 of cast refractory which serves to reduce potential deformation of the crucible 2 due to the slits 11 and to seal the slits 11, allowing the crucible 2 to be pressurized. The crucible assembly rests on an electrically insulating plate 42 which is placed on a holding bracket 44 connected to a support assembly 10.

The nozzle 8 is positioned in an orifice 5 in the bottom of the crucible 2 so that it is open to the crucible interior 22 except for the thin foil 25, which serves to isolate it therefrom. The nozzle 8 is electrically and thermally isolated from the crucible 2 by a series of insulating and clamping rings 46 which are constructed so as to allow the position of the nozzle 8 to be adjusted with respect to the crucible bottom 20. The nozzle 8 and clamping ring assembly 46 are fastened in place by means of a holding plate 48 which is bolted to the holding bracket 44.

Figure 3:
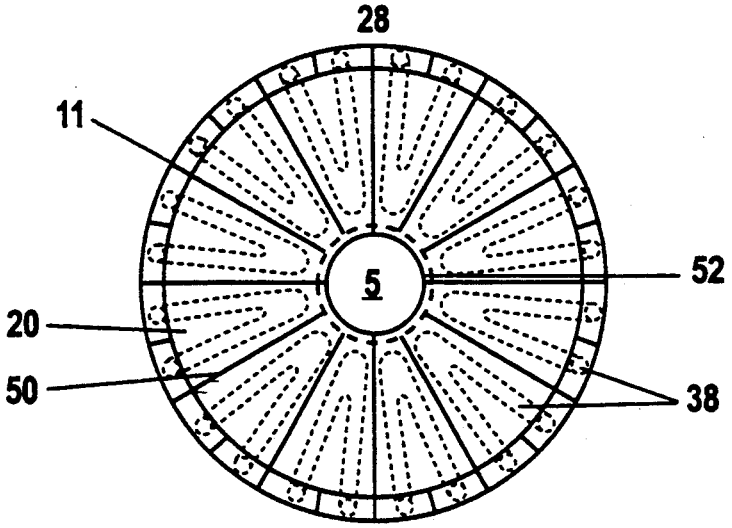
FIG. 3 shows a bottom view of the crucible illustrating construction details.

FIG. 3 is a bottom view of the crucible showing details of the segmentation. Crucible side walls 3 are divided into segments by longitudinal slits 11. In the embodiment shown, there are 24 segments. The crucible bottom 20 is divided into half the number of segments of the side walls by radial slits 50 extending nearly to the orifice 5 in the center of the bottom 20 leaving a narrow ring 52 of unsegmented material so as to provide for the structural stability of the crucible 2. The bottom slits 50 are extensions of alternating side wall slits 11. Cooling water passages 38 are placed such that pairs of side wall segments and the bottom segment to which they are connected are cooled by a separate cooling loop.

Figure 4:
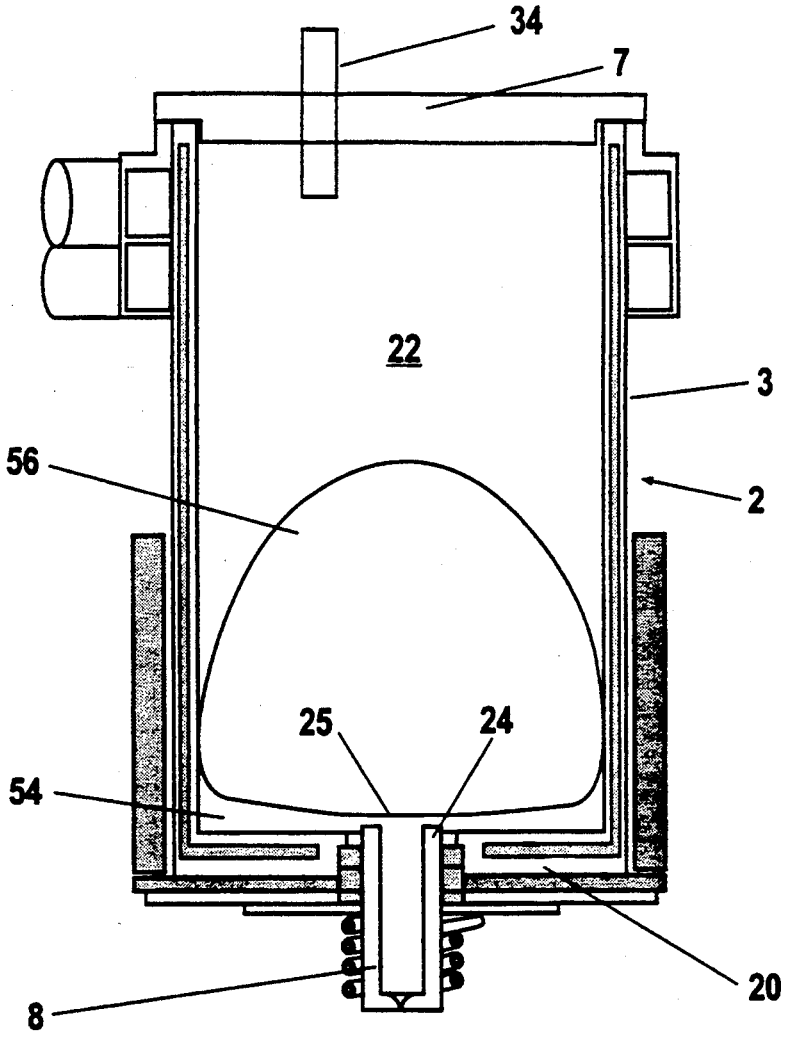
FIG. 4 shows a detailed cross sectional view of the crucible and nozzle illustrating the configuration of the metal charge during operation of the apparatus after melting but before casting has begun.

To begin a melting and rapid solidification casting operation, a thin foil 25 preferably having a thickness ranging from 0.001 to 0.2 inch, and more preferably ranging from 0.005 to 0.05 inch and a composition compatible with the ingot to be melted is placed on top of nozzle's interior surface 24; the starting material, which may consist of a single pre-alloyed ingot or a master alloy with elemental alloying additions, is placed in the crucible 2 and the cap 7 is sealed to the top of the crucible. Power is then applied to the crucible induction coil 30 and the charge is heated. As heating progresses, the charge starts to melt. Molten metal in contact with the crucible freezes so that a layer or skull 54 of solid alloy against the crucible walls 3 and bottom 20 is formed and maintained. The presence of thin foil 25 prevents any molten metal from entering prematurely into the nozzle. The configuration of the metal charge after heating and melting to form a molten metal pool 56 and skull 54 prior to the start of casting is shown in FIG. 4. Levitating forces induced by the electrical field distort the molten metal pool 56 into the general shape shown. A skull 54 of solid metal remains in the crucible, sealing the opening at the upper end 24 of the nozzle 8.

Figure 5:
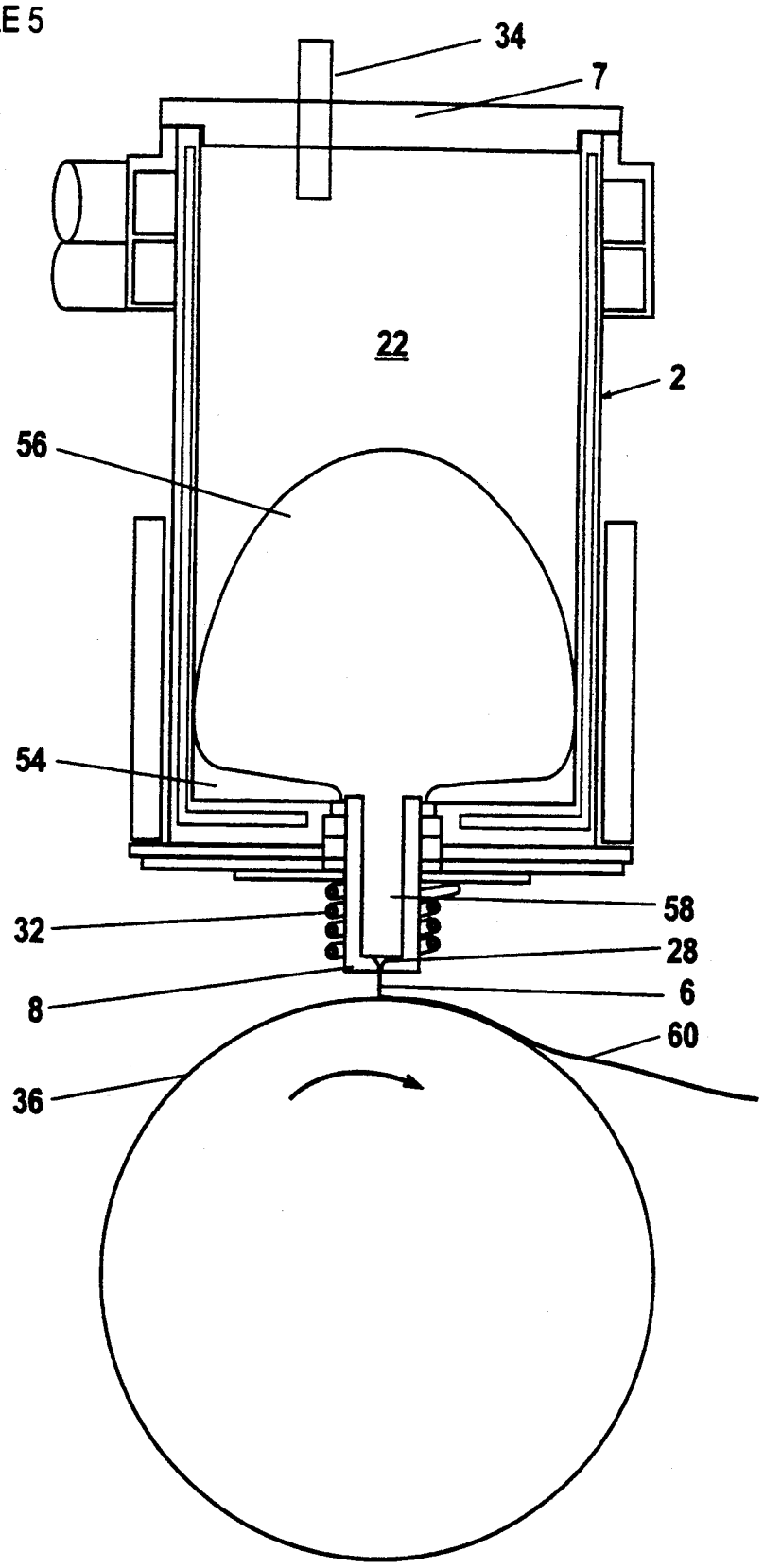
FIG. 5 shows a detailed cross sectional view of the crucible rid nozzle illustrating the configuration of the metal charge during operation of the apparatus after casting has begun.

To initiate a casting operation, shown in FIG. 5, the crucible 2 and nozzle 8 assembly is located over a moving casting substrate 36. Power to the induction coil 32 surrounding the nozzle 8 is turned on heating the nozzle 8 and melting the thin foil 25 and the solid skull 54 adjacent to the upper end 24 of the nozzle 8, allowing molten metal 56 to flow into the nozzle 8, through a passageway 58 in the nozzle interior and out the orifice in the nozzle bottom 26. The metal stream 6 exiting the nozzle 8 impinges on the moving casting substrate 36 where it is rapidly solidified into a thin filament 60. An inert gas is supplied to the crucible 2 through a port 34 in the sealing cap 7 in order to provide a pressure sufficient to maintain a metal stream 6 suitable for formation of filament 60. The gas pressure is controlled during the course of the casting operation to compensate for the reduction in metal head pressure as the crucible empties.

The following examples, in which amounts in weight percent are presented to provide a more complete understanding of the invention. The specific techniques, materials conditions and reported data set forth to illustrate the invention are exemplary and should not be construed as limiting the scope of the invention.

EXAMPLE 1

A crucible such as that shown in FIGS. 2 and 3 was constructed. The crucible had an inside diameter of 4¾ inches (12.065 cm), and inside height of 12½ inches (31.75 cm) and contained a 1½ inch (3.81 cm) diameter hole in the bottom. Longitudinal slits were cut in the bottom 7½ inches (19.05 cm) of the crucible walls, dividing the crucible in that area into 24 segments. The crucible bottom was slit radially from the outside diameter to within ½ inch (1.27 cm) of the center hole, dividing the bottom into 12 segments. Passages had been cut in the side walls and bottom so that cooling water flowed from an inlet manifold located at the top of the crucible, down twelve side wall segments, in and out of the bottom segments and back up the other twelve side wall segments to the outlet manifold. The lower 7½ inches (10.05 cm) of the crucible was encased in a ¼ inch (0.635 cm) thick layer of castable refractory.

An induction coil consisting of 11 turns of copper tubing and having an overall height of 6 inches (15.24 cm) was placed coaxially around the bottom portion of the crucible. Power for inductively heating and melting was supplied by a 3 kHz, 135 KW solid state induction power supply. The crucible and coil were placed on a holding bracket and support assembly capable of horizontal and vertical movement inside of a vacuum chamber. The charge material consisting of approximately 10 pounds of 1" diameter titanium—6% aluminum—4%. vanadium rods was placed in the crucible. A water cooled brass cap containing a fitting for the introduction of argon gas into the crucible interior was placed on top of the crucible and clamped down by means of clamps attached to the support bracket.

A nozzle fabricated from tungsten having an outside diameter of 1½ inches (3.81 cm), an inside diameter of 1 inch (2.54 cm) and an overall height of 1½ inches (3.81 cm) was inserted into the orifice in the crucible bottom and fastened in place using a series of clamping rings and a holding plate attached to the underside of the crucible support plate. A thin foil of pure titanium having a thickness of 3/16" (0.48 cm) was placed over the interior of the nozzle.

The charge was then heated by applying power to the induction coil. As the charge heated up and melted, molten liquid flowed until it connected the crucible walls or bottom and froze, forming a solid skull. By varying the heating rate and applied power levels, conditions were established which resulted in the entire charge being melted and contained within a solid skull. With this configuration, however, liquid metal flow through the nozzle could not be initiated.

EXAMPLE 2

The apparatus described in Example 1 was modified by the addition of a 3 turn induction coil with an overall height of 1½ inches (3.81 cm) located coaxially with a nozzle similar to that of Example 1 but with a length of 3 inches (7.62 cm). Power to the coil was provided by 10 kHz, 10 KW solid state induction power supply. The general procedures outlined in Example 1 were followed except that power to the nozzle induction coil was applied at the same time that the crucible charge was being heated and melted. When heating rates and power levels were adjusted appropriately, molten metal from the crucible flowed into the nozzle and out of the orifice until the crucible was emptied except for a skull on the crucible bottom.

EXAMPLE 3

The apparatus outlined in Example 1 and the procedures outlined in Examples 1 and 2 were used to make a rapid solidification run. A pre-alloyed ingot containing approximately 65% titanium and 35% aluminum weighing approximately 10 lobs (4.53 kg) was placed in the crucible and elemental vanadium was added to make up about 1.75% of the total charge weight. Power levels are adjusted to allow the charge to melt and the vanadium to dissolve without molten flowing into the nozzle. Power levels were then increased to allow the molten metal to flow into and through the nozzle.

Immediately after nozzle flow had been established, the crucible/nozzle assembly was moved over the casting wheel, which had already been turned on. The molten metal stream impinged on the wheel and solidified, worming thin ribbon which came off the wheel downstream of the impingement point.

The rapidly solidified ribbon was approximately 0.17 inches (0.43 cm) wide and 0.002 inches (0.005 cm) thick. The composition was analyzed as 35.0% aluminum, 1.74% vanadium and 63.3% titanium.

EXAMPLE 4

Two rapid solidification casting runs were made with the apparatus of the invention following the same general procedures outlined in Examples 1, 2 and 3. The charge material for these casts consisted of pre-alloyed ingots a nominal composition of 61.2% titanium, 14.1% aluminum, 19.5% niobium, 3.2% vanadium and 2.0% molybdenum. In one 3.9 kg of a 5.5 kg charge was cast and in the second, 1.5 kg of a 3.3 kg charge was cast, the balance Ox the charges remaining in the crucible as solid skull. The ribbons were approximately 0.002 inches (0.005 cm) thick. The composition of the ribbon in one cast was 13.9% Al, 19.4% Nb, 3.09% V and 1.9% Mo with the balance being titanium and in the other, 13.8% Al, 19.2% Nb, 3.19% V and 1.87% Mo with the balance being titanium. This demonstrates the reliability and repeatability of the invention.

EXAMPLE 5

Ribbons prepared as in examples 3 and 4 were examined. It was found that ribbons containing interstitial impurities less than about 700 ppm $O_2$, 420 ppm $N_2$ and 200 ppm C and having a thickness less than about 0.003 inches (0.008 cm) had significant ductility. Ductility was indicated by the capability of bending a ribbon back over upon itself without fracture.

EXAMPLE 6

Ribbon prepared as in example 4 having a composition of 13.9% Al, 19.4% Nb, 3.09% V, 1.90% Mo with the balance being titanium was subjected to hammer milling to produce a −35 mesh powder. The powder was placed in a 1 inch diameter by 6 inch long cylindrical stainless steel can, vacuum out gassed and then sealed under vacuum. The cans were then hot isostatically pressed to produced a fully dense article after the can was removed.

Having thus described the invention in rather full detail it will be understood that such detail need not be strictly adhered to but that various changes or modifications may suggest themselves to one skilled in the art, all falling within the scope of the invention as defined by the subjoined claims.

We claim:

1. Apparatus for melt spinning of metal alloys, comprising:

(a) crucible means for holding a metal charge, said crucible means being constructed of copper, having side walls, a top and a bottom having an orifice therein, said side walls, top and bottom defining, collectively, an interior of said crucible and being divided over a portion of their dimensions by longitudinal slits into at least two segments;

(b) nozzle means disposed partially within said crucible means and extending through said orifice, said nozzle means comprising a first end isolated from communication with said interior by a thin metal foil and in communication with a second end through a passageway in said nozzle, and said second end further comprising a nozzle orifice for defining a stream of molten metal alloy;

(c) cooling means for continuously cooling said top side walls and bottom to establish and maintain a layer of solid metal alloy from said charge thereagainst and thereby prevent contact between said molten metal and said side walls and bottom;

(d) first induction means for inducing an alternating electrical current within said metal charge to melt said charge;

(e) second induction means for inducing an electrical current within said nozzle to melt said thin metal foil and a portion of said layer adjacent said first end to establish communication with said interior and initiate flow of said melted charge through said passageway and nozzle orifice;

(f) pressure control means for establishing and maintaining positive pressure within said interior;

(g) quenching means including a rapidly moving chill substrate;

(h) positioning means for positioning said crucible and nozzle means relative to said quenching means; and (i) enclosure means for enclosing said crucible, nozzle and quenching means to provide there within a controlled atmosphere having positive or negative pressure.

2. A process for melting and rapid solidification eating of metal alloys, comprising the steps of:

(a) placing a solid charge composed of a metal alloy within an interior of a crucible means that is constructed of copper and has side walls, a top and a bottom, said bottom having an orifice therein, said side walls top and bottom defining, collectively, said interior, and said side walls and bottom being divided over a portion of their dimensions by longitudinal slits into at least two components;

(b) melting said charge within said interior by inducing an alternating electrical current there within;

(c) continuously cooling said crucible walls and bottom to establish and maintain a layer of solid metal alloy from said melted charge thereagainst and thereby prevent contact between said molten metal and said side walls and bottom of said crucible;

(d) heating a nozzle disposed partially within said crucible means and extruding through said orifice, said nozzle means comprising a first end isolated from communication with said interior by a thin metal foil and in communication with a second end through a passageway in said nozzle, and said second end comprising a nozzle orifice, to melt said thin metal foil and a portion of said layer adjacent said first end, establishing communication with said interior and initiating flow of said melted charge through said passageway and nozzle orifice;

(e) pressurizing said interior to establish and maintain therewithin a positive pressure, providing for flow of said melted charge through said nozzle orifice at a controlled flow rate; and (f) directing a stream, formed by flow of said melted charge through said nozzle orifice, into contact with a rapidly moving chill substrate to rapidly solidify said melted charge.

* * * * *

UNITED STATES PATENT AND TRADEMARK OFFICE

CERTIFICATE OF CORRECTION

PATENT NO. : 5,427,173

DATED : Jun. 27, 1995

INVENTOR(S) : Santosh K. Das, Richard L. Bye, Alexander Lobovsky

It is certified that error appears in the above-identified patent and that said Letters Patent is hereby corrected as shown below:

INVENTOR:
"Alexander Loboysky" should read --Alexander Lobovsky--.

ATTORNEY:
"Ernest D. Nuff" should read --Ernest D. Buff--.

IN THE CLAIMS:
Column 10, lines 28-29, replace "eating" with --casting--.

Signed and Sealed this

Twenty-third Day of January, 1996

*Attest:*

Bruce Lehman

BRUCE LEHMAN

*Attesting Officer*

*Commissioner of Patents and Trademarks*